US005580131A

United States Patent [19]

Ribot

[11] Patent Number: 5,580,131

[45] Date of Patent: Dec. 3, 1996

[54] FOLDING CHAIR

[75] Inventor: Carlos M. Ribot, Barcelona, Spain

[73] Assignee: Cister Ediciones, S.L., Barcelona, Spain

[21] Appl. No.: 478,549

[22] Filed: Jun. 7, 1995

Related U.S. Application Data

[63] Continuation of PCT/ES94/00101 Oct. 18, 1994.

[30] Foreign Application Priority Data

Oct. 18, 1993 [ES] Spain ..... 9302718

[51] Int. Cl.[6] ..... A47C 7/00

[52] U.S. Cl. ..... 297/440.12

[58] Field of Search ..... 297/440.12; 248/174

[56] References Cited

U.S. PATENT DOCUMENTS

| | | | |
|---|---|---|---|
| 2,049,659 | 8/1936 | Parrott . | |
| 2,806,514 | 9/1957 | Smith . | |
| 3,463,546 | 8/1967 | Giebel . | |
| 3,604,751 | 9/1971 | Caigan . | |
| 3,606,459 | 9/1971 | Krone . | |
| 3,664,705 | 5/1972 | Brody et al. . | |
| 4,648,658 | 3/1987 | Calco | 297/440.12 |
| 4,984,848 | 1/1991 | Scalisi et al. . | |

FOREIGN PATENT DOCUMENTS

| | | |
|---|---|---|
| 384538 | 11/1987 | Austria . |
| 729698 | 8/1969 | Belgium . |
| 1654353 | 2/1971 | Germany . |
| 1156963 | 7/1969 | United Kingdom . |
| 9101665 | 2/1991 | WIPO . |

*Primary Examiner*—Peter R. Brown
*Assistant Examiner*—Anthony D. Barfield
*Attorney, Agent, or Firm*—Darby & Darby, P.C.

[57] ABSTRACT

A folding chair composed from a blank of stamped material, having various fold lines that define zones in the blank. The blank includes two central zones of a higher height than the remaining zones, two side prolonged zones that protrude from the lateral sides of the central zones, and two inner prolonged zones extending from the side prolonged zones and joined together with at least one connection flange. The blank further includes an "ear" extending from an upper edge of one of the side prolonged zones and forming the seat of the chair and an "ear" extending from an upper area of the side prolonged zone and forming the back of the chair. Each ear is provided with a respective connection flange. The chair is formed by folding the blank along the fold lines and then joining the connection flanges to their designated connection areas.

20 Claims, 3 Drawing Sheets

FOLDING CHAIR

BACKGROUND OF THE INVENTION

The present invention relates to a folding chair formed from a substantially lightweight yet sturdy material. More particularly, the present invention relates to a folding chair formed from a blank of lightweight material divided into a plurality of successive zones joined along fold lines about which the blank is folded to form a chair in either usable or folded configuration.

Presently, there are several types of folding chairs on the market, most of them being formed by foldably (pivotally) joining tubular frameworks that respectively support the sides of rectangular pieces of fabric corresponding to the seat and the back of the chair. This type of folding chair is amply used at the present, however the volume, the weight, and the space such chairs occupy make such chairs bulky and not especially convenient to store.

SUMMARY OF THE INVENTION

It is therefore an object of the present invention to form a folding chair from a lightweight yet sturdy material that may be folded flatter than prior art folding chairs and is not as bulky as prior art folding chairs.

It is a related object of the present invention to provide a blank of substantially lightweight yet sturdy material having a plurality of successive zones joined along fold lines such that the blank may be folded into a either a usable or a folded configuration of a chair.

It is a further object of the present invention to provide a method of forming a foldable chair from a blank of substantially lightweight yet sturdy material.

In accordance with the principles of the present invention, a folding chair, formed from a sheet of a stamped material, such as cardboard or the like, is provided. The blank has a plurality of successive zones joined along fold lines. The blank is folded along the fold lines so that a very light type of chair is obtained, which is also very manageable, easy to transport, and very cheap to manufacture.

These and other features and advantages of the present invention will be readily apparent from the following detailed description of the invention, taken in conjunction with the accompanying drawings, wherein like reference characters represent like elements.

DESCRIPTION OF THE PREFERRED EMBODIMENT

Figure 1:
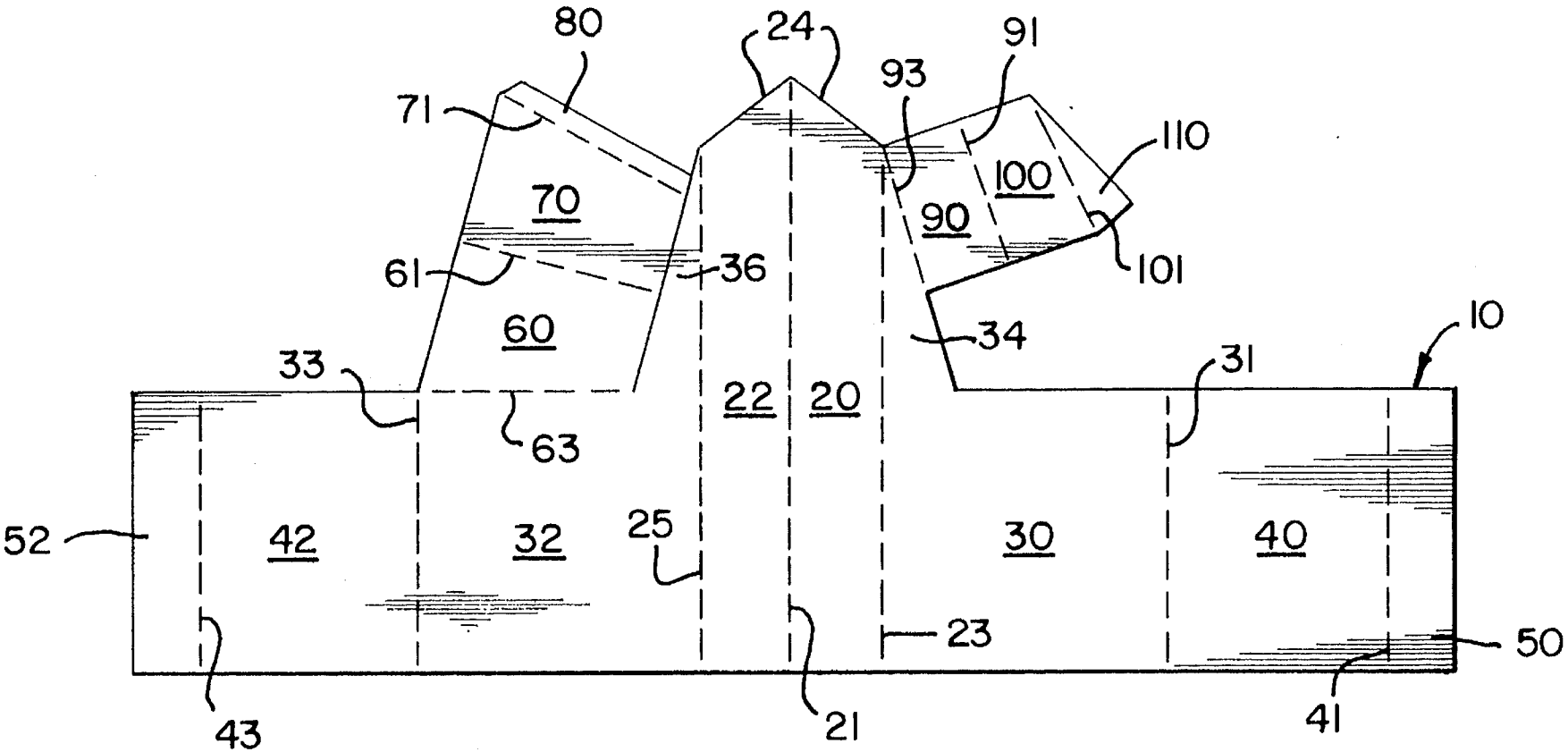
FIG. 1 is a plan view of a blank for forming the chair of the present invention.

The chair of the present invention is formed from a blank 10 of stamped material such as cardboard. As shown in FIG. 1, blank 10 is comprised of successive forms or zones joined along respective fold lines that permit an easy framework for subsequent fast folding into a chair. The chair may be positioned either in a folded configuration, as in FIG. 2, or as a chair 12 in usable form, as in FIGS. 3–6.

As shown in FIG. 1, blank 10 has two central zones 20 and 22 joined along a fold line 21. Central zones 20 and 22 extend vertically along blank 10, each having an upper region 24 forming the back area of the chair 12 when the blank 10 is folded to form a chair 12. Each central zone 20, 22 also is prolonged horizontally along the free substantially vertical edges of central zones 20 and 22 into respective zones 30, 40 and 32, 42, ending in respective connection flanges 50, 52. Thus, side prolonged zone 30 (which forms a side of chair 12) extends from central zone 20 along fold line 23, and side prolonged zone 32 extends from central zone 22 along fold line 25. Similarly, inner prolonged zone 40 (which forms an interior support for chair 12) extends from side prolonged zone 30 along fold line 31 and inner prolonged zone 42 (which also forms an inner support for chair 12) extends from side prolonged zone 32 along fold line 33. Connection flanges and 50 and 52 extend, respectively, from inner prolonged zones 40 and 42 along fold lines 41 and 43.

In order to form the basic framework of chair 12, fold lines 21, 23, 25, 31, 33, 41, and 43 are respectively folded so that connection flanges 50 and 52 meet and may be connected to each other. As a result, inner zones 40 and 42 are positioned between side zones 30 and 32 when the chair 12 is in the usable position to support the seat of the chair, and connection flanges 50 and 52 are substantially co-planer with inner zones 40 and 42 when the chair is in the folded position of FIG. 2.

The seat of the chair is constituted by an "ear" formed by preferably two seat zones 60 and 70, joined along fold line 61. Preferably, zone 60 extends from the upper substantially horizontal edge of side zone 32, along fold line 63. A seat connection flange 80 extends from seat zone 70 along fold line 71. Seat connection flange 80 is connected to the upper substantially horizontal edge of side zone 30 to form the seat of chair 12.

In a similar manner, the back of chair 12 is formed from another "ear" formed from preferably two back zones 90 and 100, joined along fold line 91. Back zones 90 and 100 preferably extend from the upper vertex 34 of side prolonged zone 30 along fold line 93. A back connection flange 110 extends from back zone 100 along fold line 101. Back connection flange 110 is connected to the upper vertex 36 of side zone 32 to form the back of chair 12 from back zones 90 and 100.

Because each zone is separated from its adjoining zone along a fold line, the folding of blank 10 into a chair 12 is easy to accomplish. Moreover, once connection flanges 50, 52, 80, and 100 have been joined to their respective flanges or zones, the chair thereby formed may be folded into the folded configuration shown in FIG. 2. As may be seen in FIG. 2, blank 10 may be folded into a substantially flat configuration. The seat of the chair and the back of the chair fold along fold lines 61 and 91, respectively, away from the basic framework of the chair so that zones 60 and 100 are substantially co-planar with each other and also with zones 22, 32, and 42. Likewise, zones 20, 30, 40, 70 and 90 are substantially co-planar on the other side of the folded chair (not seen in FIG. 2, but covered by the zones that are shown in FIG. 2).

Figure 2:
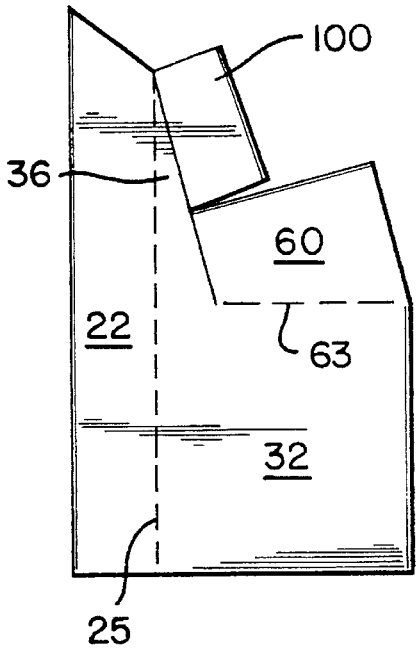
FIG. 2 is a side view of the chair of the present invention in a folded configuration.
Figure 3:
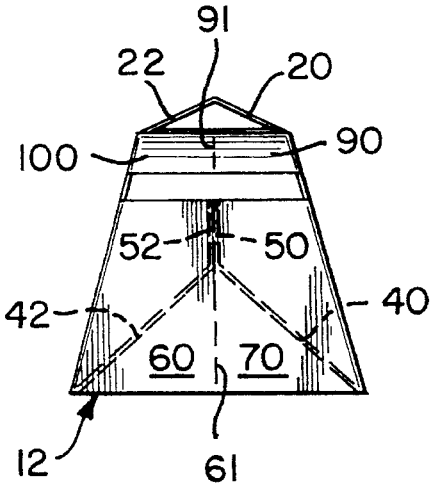
FIG. 3 is a plan view of the chair of the present invention in a usable configuration.
Figure 4:
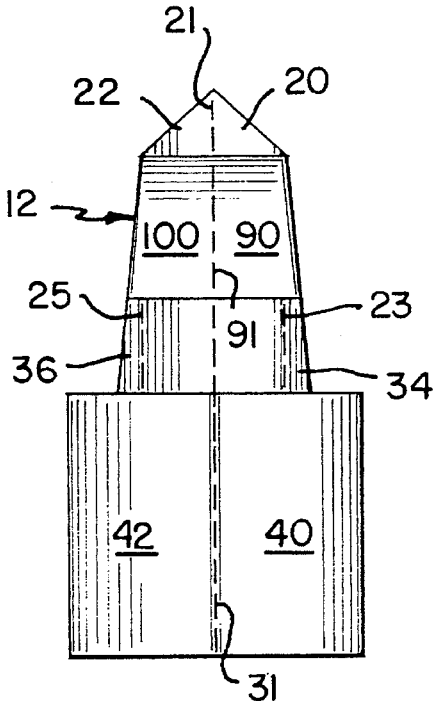
FIG. 4 is a front elevational view of the chair of the present invention in a usable configuration.
Figure 5:
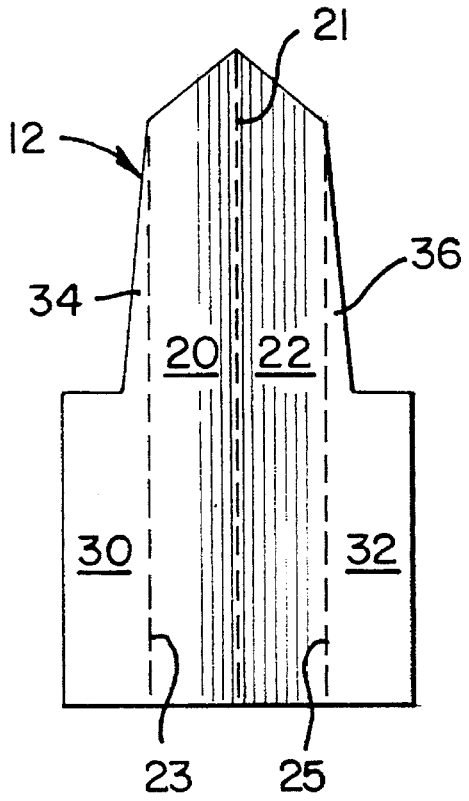
FIG. 5 is a back elevational view of the chair of the present invention in a usable configuration.
Figure 6:
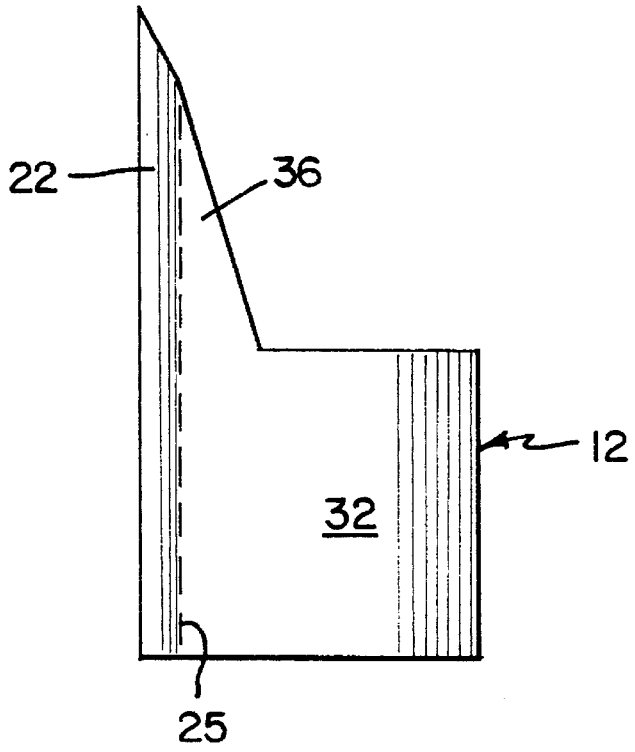
FIG. 6 is a side view of the chair of the present invention in a usable configuration.

Once the folded chair of FIG. 2 is unfolded into a usable configuration, a lightweight sturdy chair 12, such as shown in FIGS. 3–6, is formed. From the plan view of FIG. 3, it may be understood that central zones 20 and 22 are at an angle with respect to each other so that chair back zones 90 and 100 may be substantially co-planar. Seat zones 60 and 70 are substantially co-planar and horizontal to provide a seat for a user. As seen in phantom in FIG. 3, inner zones 40 and 42 are joined along connection flanges 50 and 52, and in the usable configuration of chair 12, form a support for seat zones 60 and 70. Inner zones 40 and 42 may be more easily observed from the front elevational view of FIG. 4. As seen from the back elevational view of FIG. 5, blank 10 forms a one-piece wall forming the basic framework of chair 12, blank 10 having a plurality of angled areas at fold lines 21, 23, 25, 31, 33 to thereby form a gradually widening basic framework structure for the chair 12. In the side view of FIG. 6, the back 100 of chair 12 may be seen as gradually sloping backwards to form an obtuse angle between the seat and the back of the chair 12.

It will be understood that the union of connection flanges 50 and 52 to each other, the union of seat connection flange 82 to the upper edge of side zone 30, and the union of back connection flange 110 to the upper vertex 36 of side zone 32 may be realized by any conventional means that guarantees permanent fixation during the use of the chair. For example, one of the many types of adhesives that are usually used by those skilled in the art for such purposes may be used.

Thus, with the present invention, a type of folding chair is obtained that is extremely efficient and cheap to manufacture, and is easy to form, fold, and store, thereby resolving the major inconveniences of the folding chairs of the prior art.

From the foregoing description, it will be clear that the present invention may be embodied in other specific forms without departing from the spirit or essential characteristics thereof. The presently disclosed embodiment is therefore to be considered in all respects as illustrative and not restrictive, the scope of the invention being indicated by the appended claims, and not limited to the foregoing description.

What is claimed is:

1. A folding chair formed from a blank of lightweight yet sturdy material having successive zones separated by fold lines, said folding chair comprising:

a basic framework formed by a plurality of zones joined along substantially vertical fold lines including a midline fold line, right and left side fold lines, and first and second seat support fold lines, said blank being folded along said midline fold line to form a right back zone between said midline fold line and said right side fold line and a left back zone between said midline fold line and said left side fold line, said blank being further folded along said right and left side fold lines to form right and left side zones each having a substantially horizontal upper side edge, and being further folded along said first and second seat support fold lines to form a seat support structure extending from at least one of said right and left side zones, at least said right and left back zones forming a back area having right and left back area sides of said basic framework;

a seat formed by a seat zone extending from the upper side edge of one of said right and left side zones along a seat fold line and having a free seat zone edge opposite said seat fold line connected to the upper side edge of the other of said right and left side zones, said seat support structure and said seat being folded so that said seat is supported by said seat support structure; and a back support formed by a back support zone extending from one of said right and left back area sides of said basic framework along a back support fold line, said back support having a free back zone edge, opposite said back support fold line, connected to the other of said right and left sides of said back area;

wherein each of said zones is foldable along a respective fold line so that said chair folds into a substantially flat folded configuration, and, while said chair is in said substantially flat folded configuration, said seat zone edge remains connected to said upper side edge of said other of said right and left side zones and said back zone edge remains connected to said other side of said back area.

2. A folding chair as in claim 1, wherein said right and left back zones have an upper region extending above said upper side edges of said right and left side zones.

3. A folding chair as in claim 2, wherein each of said fight and left side zones includes an inclined edge extending from a respective upper side edge to a respective side fold line adjacent said upper region of said back zones to form an upper extension of each of said side zones, said back area further including said upper extension of each of said side zones.

4. A folding chair as in claim 5, wherein said back support zone extends from an upper extension of one of said right and left side zones.

5. A folding chair as in claim 1, wherein said seat is formed of two seat zones joined along a seat midline fold line.

6. A folding chair as in claim 1, wherein said back support is formed of two back support zones joined along a back support midline fold line.

7. A folding chair as in claim 1, wherein said seat zone further comprises a seat connection flange for connecting said seat zone to the upper side edge of the other of said and right and left side zones.

8. A folding chair as in claim 1, wherein said back support zone further comprises a back connection flange for connecting said back support to said other of said right and left side zones.

9. A folding chair as in claim 1, wherein said blank is formed from cardboard.

10. A folding chair as in claim 1, wherein:

said right side zone is formed between said right side fold line and said first seat support fold line;

said left side zone is formed between said left side fold line and said second seat support fold line; and said seat support structure comprises a right seat support zone extending from and folded along said right seat support fold line and a left seat support zone extending from and folded along said left seat support fold line.

11. A folding chair as in claim 10 wherein each of said right and left seat support zones has a free edge spaced from said support fold line, said basic frame structure further comprising at least one connection flange extending from a free edge of one of said right and left seat support zones for joining said right and left seat support zones to each other.

12. A blank of lightweight yet sturdy material for forming into a folding chair configuration, said blank comprising:

right and left seat support zones each having a substantially horizontal upper support edge;

right and left side prolonged zones extending along respective substantially vertical right and left support fold lines between said right and left seat support zones, each of said right and left side prolonged zones having a substantially horizontal side zone upper edge substantially collinear with and adjacent said upper support edges of said right and left seat support zones, and an inclined edge extending upwardly and away from said side zone upper edges;

a seat zone extending from said side zone upper edge of one of said right and left side prolonged zones along a substantially horizontal seat zone fold line;

a central zone having right and left sides extending along respective substantially vertical right and left side fold lines between said right and left side prolonged zones, said central zone having a back area extending above said side zone upper edges and said upper support edges, said inclined edges extending between said side zone upper edges and said right and left side fold lines to form an upper side region adjacent at least a portion of said back area;

a back zone extending from said upper region of the other of said right and left side prolonged zones along a back zone fold line;

wherein, in the folding chair configuration:

said seat support zones are folded along said substantially vertical support fold lines to be positioned between said right and left side zones;

said seat zone is folded along said seat zone fold line and connected to said side zone upper edge of the other of said right and left side prolonged zones so that said seat zone is supported by said upper support edges of said right and left seat support zones; and said back zone is folded along said back zone fold line and connected to said upper side region of said one of said right and left side prolonged areas from which said seat zone extends.

13. A blank as in claim 12, further comprising:

a support connection flange extending from at least one of said right and left seat support zones along a support flange fold line for connection of said right and left seat support zones to each other;

a seat flange extending from said seat zone along a seat flange fold line for connection of said seat zone to said side zone upper edge of the other of said right and left side prolonged zones; and a back flange extending from said back zone along a back flange fold line for connection of said back flange to said upper side region of said one of said right and left side prolonged zones from which said seat zone extends.

14. A blank as in claim 13, wherein said at least one support connection flange includes a support connection flange on each of said right and left seat support zones, said support connection flanges being positioned for connection to each other.

15. A blank as in claim 12, wherein said central zone comprises right and left central zones joined along a substantially vertical midline fold line.

16. A blank as in claim 12, wherein said seat zone further comprises right and left seat zones joined along a seat midline fold line.

17. A blank as in claim 12, wherein said back zone comprises right and left back zones joined along a back zone midline fold line.

18. A blank as in claim 12, wherein said blank is formed of cardboard.

19. A method of forming a folding chair from a blank of lightweight yet sturdy material, said folding chair having a back and a seat, said blank comprising a plurality of successive zones joined along respective fold lines, said zones including:

right and left central zones joined along a substantially vertical central fold line, said right and left central zones having an upper area at the back of the chair and a lower area at the seat of the chair, said right central zone having a right substantially vertical edge, and said left central zone having a left substantially vertical edge;

right and left side prolonged zones extending respectively from said right substantially vertical edge and said left substantially vertical edge of said right and left central zones, each of said right and left side prolonged zones having an upper side region connected along the upper area of said right and left central zones, and prolonged horizontal sections extending along and away from the lower area of said central zones, each of said substantially horizontal prolonged areas having a substantially horizontal upper edge, said right side prolonged zone having a substantially vertical right edge and said left side prolonged zone having a substantially vertical left edge;

substantially symmetrical right and left seat support zones extending respectively from said substantially vertical right and left edges of said right and left side prolonged zones, each of said seat support zones having a substantially horizontal upper support edge substantially collinear with and adjacent said upper edges of said horizontal prolonged areas, said right seat support zone having a substantially vertical right free edge, and said left seat support zone having a substantially vertical left free edge;

a support connection flange extending from one of said substantially vertical right and left free edges of said seat support zones along a support flange fold line;

a seat zone extending from an upper edge of one of said right and left side prolonged zones along a seat zone fold line, said seat zone comprising right and left seat zones joined along a seat midline fold line;

a seat connection flange extending from said seat zone along a seat flange fold line for connecting said seat zone to an upper edge of the other of said right and left side prolonged zones;

a back zone extending from said upper side region of the other of said right and left side prolonged zones along a back zone fold line, said back zone comprising right and left back zones joined along a back zone midline fold line; and a back connection flange extending from said back zone along a back flange fold line for connection of said back zone to said upper side region of said one of said right and left prolonged zones from which said seat zone extends;

wherein said method comprises the steps of:

folding said right and left central zones at an angle with respect to each other along said central fold line;

folding said right and left side prolonged zones at an angle with respect to said right and left central zones, respectively, along said right and left substantially vertical edges of said right and left central zones;

folding said right and left seat support zones, along respective ones of said substantially vertical right and left edges of said right and left side prolonged zones, at an angle with respect to said right and left side prolonged zones, respectively, so that said right and left seat support zones are positioned between said right and left side prolonged zones;

connecting said support connection flange to said other of said substantially vertical right and left free edges of said seat support zones;

folding said seat zone along said seat zone fold line and over said seat support zones to be supported by said upper support edges of said seat support zones;

connecting said seat connection flange to the upper edge of the other of said right and left side prolonged zones;

folding said back zone along said back zone fold line; and connecting said back connection flange to said upper side region of said one of said right and left side prolonged zones from which said seat zone extends.

20. A method of forming a folding chair as in claim 19, further comprising the steps of:

folding said blank along said substantially vertical central fold line so that said right central zone and said right side prolonged zone are substantially co-planar and said left central zone and said left side prolonged zone are substantially co-planar and parallel to said right central zone and said right side prolonged zone, and said right and left seat support zones are sandwiched between said right and left side prolonged zones;

folding said blank along said seat midline fold line so that said right and left seat zones are substantially parallel; and folding said blank along said back zone midline fold line so that said right and left back zones are substantially parallel;

whereby said folding chair is thereby folded into a substantially flat folded configuration.

* * * * *